United States Patent [19]

Eriksson

[11] Patent Number: 4,633,552

[45] Date of Patent: Jan. 6, 1987

[54] TOOL HANDLE WITH ECCENTRIC TOOL GRIPPING ASSEMBLY

[76] Inventor: Karl E. S. Eriksson, 212 Lake View Dr., Summerville, S.C. 29483

[21] Appl. No.: 716,245

[22] Filed: Mar. 26, 1985

[51] Int. Cl.[4] ..... B25G 3/20

[52] U.S. Cl. ..... 29/80; 16/110 R; 16/114 R; 29/76 R; 30/340; 403/350

[58] Field of Search ..... 16/110 R, 114 R; 446/81; 81/489, 491; 279/6; 30/340; 403/350; 51/205 R; 29/76 R, 78, 79, 80

[56] References Cited

U.S. PATENT DOCUMENTS

| | | | |
|---|---|---|---|
| 1,413,101 | 4/1922 | Cushing | 16/114 R |
| 1,597,742 | 8/1926 | Turner | 446/81 |
| 2,722,153 | 11/1955 | Greco | 446/81 X |
| 2,977,668 | 4/1961 | Maness | 29/80 |
| 3,327,567 | 6/1967 | Penberthy | 29/80 X |
| 3,849,007 | 11/1974 | Recker | 403/350 X |
| 4,231,574 | 11/1980 | Williams | 403/350 X |

*Primary Examiner*—Fred Silverberg
*Attorney, Agent, or Firm*—Holman & Stern

[57] ABSTRACT

A tool handle for a file used for sharpening of saw chains consists of two interconnected tubular parts, rotatably connected in relation to each other, and each having an outer shell member surrounding a central tube having its axis offset in relation to the rotary axis. By relative rotary movement of the tubular parts, the tubes lock an inserted file by eccentric action. The tool handle is further provided with apertures forming a whistle and with angled filing guides.

9 Claims, 4 Drawing Figures

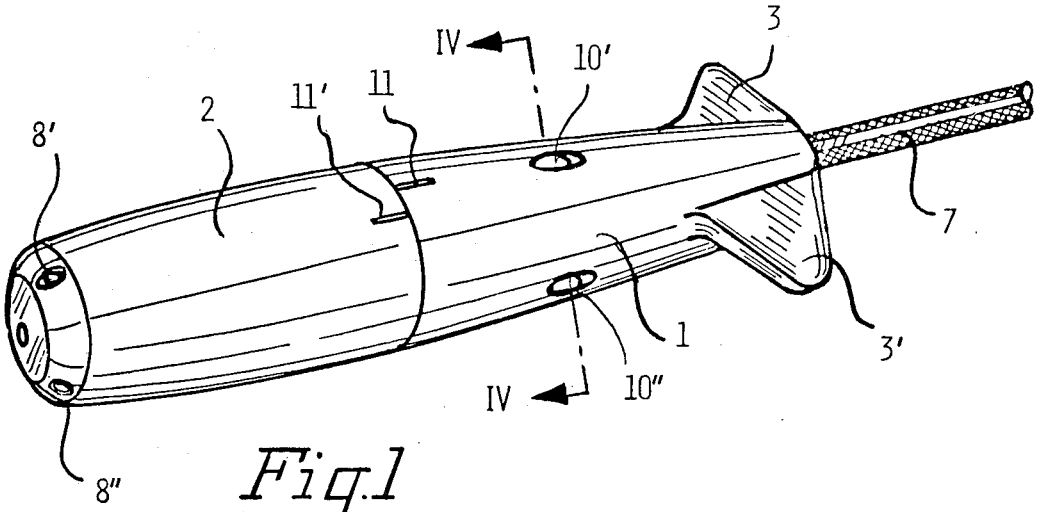
Fig. 1
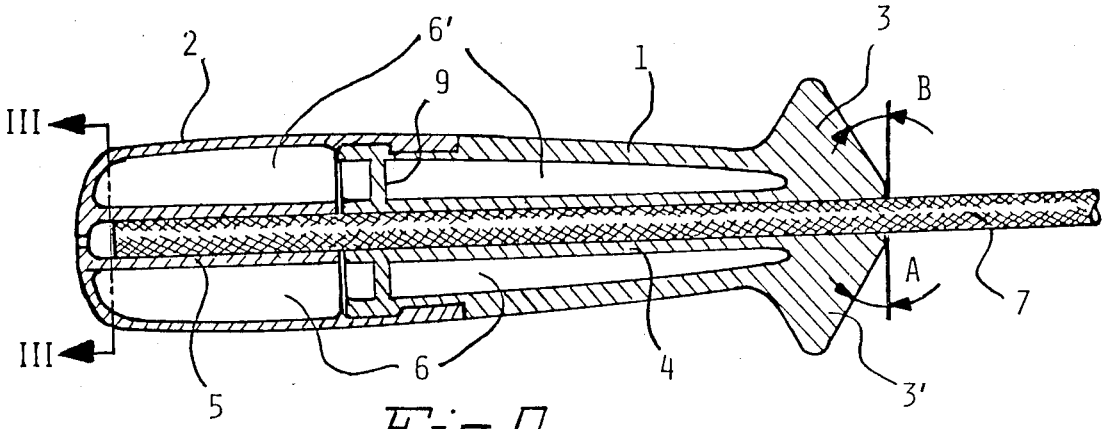
Fig. 2
Fig. 4
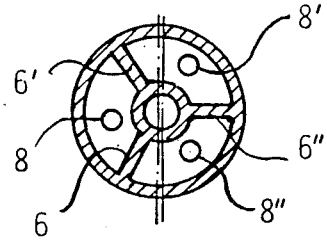
Fig. 3
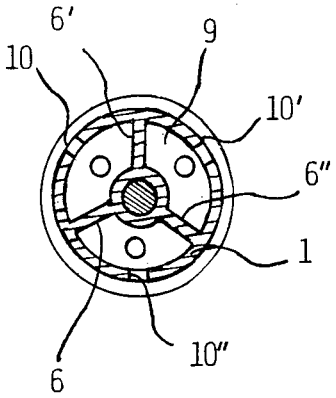

TOOL HANDLE WITH ECCENTRIC TOOL GRIPPING ASSEMBLY

The present invention relates to a tool handle, and in particular to a tool handle intended to hold a file used for sharpening of saw chains, said tool handle including an acoustic signalling means.

The saw chains of portable motor saws, as used for forestry work, must be resharpened frequently, and for this purpose a file having a circular cross-section is used. Such files may be arranged with a permanently attached tool handle, or detachably attached at one end portion to a tool handle having a clamping means, arranged with an opening into which the file can be inserted, the cross-sectional area of which can be manually varied. Since files with a permanently attached tool handle obviously are more expensive, files in combination with a detachably attached tool handle are preferred.

Due to the risk for accidents involved when using portable motor chain saws, forestry workers also require a signalling means, in order to call the attention of workers nearby, should an accident occur. Such a signalling means may be a whistle, carried by the worker. However, the workers often neglect to carry such a signalling means, or it may easily be lost.

An object of the present invention is to disclose an improved tool handle for a saw file, arranged to facilitate rapid attachment of a file, and also arranged to facilitate use of a file having a length exceeding the length of files normally used, while maintaing a short total length of extension for the tool handle with attached file.

A further object of the present invention is to disclose a tool handle, incorporasting an acoustic signalling means, whereby each worker always has a signalling means available, should an accident occur.

Other features, additional objects, and many of the attendant advantages of this invention will readily be appreciated as the same become better understood by reference to the appended drawing in which:

FIG. 1 shows a perspective view of a tool handle of the invention;

FIG. 2 shows the tool handle of FIG. 1 in longitudinal section;

FIG. 3 shows a cross-sectional view on the line III—III in FIG. 2, and

FIG. 4 shows a cross-sectional view on the line IV—IV in FIG. 1.

The tool handle consists of a a first tubular part 1 and a second tubular part 2, manufactured from a material having flexible properties, e.g. a synthetic plastics material. The first tubular part 1, forming the foremost portion of the handle, is arranged with two outwardly extending wingshaped members, 3 and 3' respectively. A longitudinally extending tube, 4 and 5 respectively, forming integrated parts with the first and the second tubular parts 1 and 2, are arranged slightly offset from the center of the tubular parts (as shown in FIG. 3), supported by three thin webs 6, 6', 6'' extending inwardly from the inner surfaces of the first and the second tubular part, 1 and 2 respectively.

The first tubular part 1 and the second tubular part 2 are rotatably joined together, interconnected by means of a inwardly directed collar at the front end portion of the second tubular part 2, extending into a surrounding groove at the rear end portion of the first tubular part 1.

By means of a rotary movement of the first tubular part 1 in relation to the second tubular part 2, the longitudinally extending tubes 5, 4 may take up a position with the center axis of each tube 5, 4 offset or displaced in relation to each other, thereby excentrically clamping a file 7 inserted into the tubes 5, 4 while same are arranged in a position having a coinciding length axis. The elastical properties of the material used, and the thin webs 6, 6', 6'' supporting the tubes 3, 4 facilitates a certain deflection or compression of the webs 6, 6', 6'' when the first and the second tubular part are rotated in relation to each other, thus enhancing the excentric action and resulting in an extremely secure attachment of the file 7.

As shown in FIG. 2, the tool handle surrounds a substantial portion of the file 7, and when the part of the file 7 extending outwardly from the tool handle has been worn, the first and the second tubular part 1, 2 are rotated in relation to each other in a rotary direction opposed to the rotary direction causing attachment, whereby the tubes 5, 4 are moved back into a position having a common center axis, thus releasing the file 7, which is removed, turned, and replaced back with the handle embracing the worn section of the file 7. The previously unused section of the file 7 can thereafter be used for sharpening purposes.

In order to facilitate the above turning operation, while maintaining the same direction of movement for the file 7 during use, the file 7 is advantageously arranged cut in two opposed directions as from the central portion of the file 7.

The wingshaped members 3, 3' act as means of engagement for the thumb and the index finger when the first and the second tubular part 1, 2 are rotated in relation to each other, but as indicated in FIG. 2, the front surfaces of same are also advantageously arranged having a different grade of inclination, as indicated by the angles A and B. By arranging, for example, the angle A inclined 30° in relation to a plane perpendicular to the file 7, and the angle B inclined 35°, two common angles used for sharpening of motor saw chains are made available, and the wingshaped members 3, 3' may thus serve as gauges used for obtaining accurate angles during a sharpening operation.

The rear portion of the second tubular part 2 is shown having three through holes 8, 8', 8'', communicating with the three chambers created by the internal webs 6, 6', 6'' of said second part 2. There is a wall member 9 located within the corresponding chambers of the first tubular member 1, arranged with a through hole into each chamber, and there are also an outlet hole 10, 10', 10'' from each one of the chambers closed by said wall member 9.

By applying the rear end portion of the tool handle to the mouth, and by blowing into the holes 8, 8', 8'', three air streams pass through the chambers in the second tubular part into corresponding chambers of the first tubular part 1 through the holes in the wall member 9, thereby causing a whistling sound, which together with the air stream passes out through the outlet holes 10, 10', 10''. The tool handle can thus be used as a whistle to call the attention of workers nearby, and this whistle does in fact act as a triple whistle, or three independent whistles, and as a result an extremely loud audiable sound is created, outperforming the conventional single acting type of a whistle.

The groove and the collar interconnecting the first and the second tubular member may also be arranged to facilitate a restricted relative rotary movement, in a first restricted rotary position arranged to located the tubes with a common length axis, and in a second restricted rotary position arranged with the length axis of each displaced in relation to each other. Such a restricted movement can be accomplished by arranging part of the groove deeper, and by arranging the collar entering the groove with a protruding portion, arranged to be located in the deeper portion of the groove, and to act as a stop member against each end part of the deeper portion during the aforementioned rotary movement.

As indicated in FIG. 1, the first and the second tubular part 1, 2 may also advantageously be arranged having external indicating marks 11, 11' to give visual indication of the position in which same are located with the tubes 3, 4 arranged extending with a coinciding longitudinal axis, and such a modification may be used both with regard to tool handles having a nonrestricted relative rotary movement, or tool handles arranged with means restricting the relative rotary movement of the first and the second tubular part 1, 2.

It should be understood, of course, that the foregoing disclosure relates only to a preferred embodiment of the invention, and that it is intended to cover all changes and modifications of the example of the invention herein chosen for the purpose of disclosure which do not constitute departure from the spirit and scope of the invention set forth in the appended claims.

What is claimed is:

1. A tool handle comprising first and second handle parts having a common longitudinal axis, a joint connecting said parts for at least limited relative rotation of the parts about said axis, means defining a longitudinally extending through bore in one of the handle parts with an opening at one end of said one handle part remote from the joint for insertion of an elongate tool into the handle, the through bore having an axis which is offset from said common longitudinal axis, means defining a further longitudinal bore in the other of said parts for receiving an end portion of the tool inserted into said through bore, the further bore also having an axis which is offset from said common longitudinal axis, the handle parts having a relative rotational position wherein the respective axes of said through bore and further bore are substantially coaxially aligned for receipt of the tool and wherein relative rotation of the parts from said position about the common longitudinal axis provides relative eccentric displacement of the respective axes of the through bore and further bore effective for clamping the tool in the handle.

2. A tool as defined in claim 1 wherein the respective handle parts comprise respective outer shell members, respective internal tubes defining the through bore and further bore, and respective web elements connecting the tubes and shell members.

3. A tool handle as defined in claim 2 including a whistle blowing air inlet aperture in at least one of the shell members, a whistle blowing air outlet aperture in at least one of the shell members, and a communication aperture formed through at least one of said web members between the inlet and outlet apertures.

4. A tool handle as defined in claim 3 including circumferentially spaced elongate webs connected between the respective tubes and shell members dividing the handle parts into plural elongate air chambers, and wherein the handle includes whistle blowing air inlet, outlet and communication apertures as aforesaid for each chamber.

5. A tool handle as defined in claim 2 wherin the joint comprises interfitting annular bearing portions on the respective shell members of the handle parts.

6. A tool handle as defined in claim 2 wherein the handle parts are made of plastic.

7. A tool handle as defined in claim 1 wherein said one handle part includes outwardly extending wing shaped members adjacent said opening, the wing shaped members having respective forward edges which are inclined relative to said common axis at respectivley different angles to provide differently angled cutting guides.

8. A tool handle as defined in claim 1 wherein the handle parts have respective external indicator marks which are mutually aligned only in said rotational position of the parts.

9. A tool handle as defined in claim 1 wherein the through bore and further bore together extend substantially the entire length of the handle.

* * * * *